US006621461B1

(12) United States Patent
Ramanujam et al.

(10) Patent No.: US 6,621,461 B1
(45) Date of Patent: Sep. 16, 2003

(54) GRIDDED REFLECTOR ANTENNA

(75) Inventors: Parthasarathy Ramanujam, Redondo Beach; Brian M. Park, Torrance, both of CA (US); Paul E. Guillaume, El Paso, TX (US); Cameron Massey, Hawthorne, CA (US)

(73) Assignee: Hughes Electronics Corporation, El Segundo, CA (US)

( * ) Notice: Subject to any disclaimer, the term of this patent is extended or adjusted under 35 U.S.C. 154(b) by 328 days.

(21) Appl. No.: 09/636,085

(22) Filed: Aug. 9, 2000

(51) Int. Cl.[7] ..... H01Q 19/14; H01Q 15/02
(52) U.S. Cl. ..... 343/781 R; 343/909; 343/753
(58) Field of Search ..... 343/781 R, 781 P, 343/781 CA, 909, 753, 756, DIG. 2; H01Q 19/14, 15/02

(56) References Cited

U.S. PATENT DOCUMENTS 4,625,214 A * 11/1986 Parekh ..... 343/756
5,160,937 A * 11/1992 Fairlie et al. ..... 343/781 P
5,581,265 A * 12/1996 Stirland et al. ..... 343/756
5,673,056 A * 9/1997 Ramanujam et al. ..... 343/756
6,052,095 A * 4/2000 Ramanujam et al. .... 343/781 P

* cited by examiner

*Primary Examiner*—Hoanganh Le
(74) *Attorney, Agent, or Firm*—Gates & Cooper LLP

(57) ABSTRACT

A method for broadcasting, a signal, and an antenna system are disclosed. The antenna system comprises a feed horn and a reflector. The feed horn provides a radio frequency (RF) signal. The reflector is aligned with the feed horn and is illuminated by the feed horn, and comprises a reflective grid. The reflective grid lines are substantially parallel as viewed from a geographic location of a desired output beam from the antenna system. A method in accordance with the present invention comprises illuminating a reflector with an RF signal emanating from a feed horn, the feed horn being substantially located at a focal point of the reflector, wherein the reflector comprises a reflective grid, and reflecting the RF signal with the reflective grid, wherein lines of the reflective grid are substantially parallel as viewed from a geographic location of a desired output beam from the antenna system.

15 Claims, 11 Drawing Sheets

GRIDDED REFLECTOR ANTENNA

BACKGROUND OF THE INVENTION

1. Field of the Invention

This invention relates in general to antenna systems, and in particular to a gridded reflector antenna system.

2. Description of Related Art

Communications satellites have become commonplace for use in many types of communications services, e.g., data transfer, voice communications, television spot beam coverage, and other data transfer applications. As such, satellites must provide signals to various geographic locations on the Earth's surface. As such, typical satellites use customized antenna designs to provide signal coverage for a particular country or geographic area.

In order to provide good cross-polarization performance over the geographic region of interest, a shaped dual reflector geometry is often used. The subreflector and/or main reflector is shaped to generate a beam pattern that covers the intended coverage geographic region.

An advantage of dual reflector designs is that the main reflector is thin and therefore generally easy to package and stow in the confines of the launch vehicle volume constraints. A typical dual reflector antenna system can provide one beam for each of two linear polarizations. However, typical dual reflector antenna systems have a main reflector that has only one solid surface, and therefore can generate only one distinct beam shape.

Alternately, a "dual-gridded" shaped reflector system may be used to produce beams over the desired coverage area. This type of antenna system is a shared aperture system having two separate reflective surfaces, one reflective surface for each polarization. Each reflective surface, also called grids, maybe shaped to produce a distinct beam shape for each polarization.

The related art shapes the grid pattern surface geometry, e.g., places undulating waves and/or distorts the grid surface in the z-direction to shape the beam to the desired size and/or location. Further, the related art moves the feed horn location to again move the beam location or change the beam size. The related art requires for a single reflector with two feed horns of opposite polarizations, the focal points of each grid must be separated to provide adequate cross-polarization performance. The resulting reflector shell becomes large and thick, and therefore difficult to package and stow within the confines of the launch vehicle constraints. The use of multiple antennas can also produce multiple beam patterns, however, multiple antennas within a system also produce space and deployment problems for the satellite and make it difficult to design the satellite to fit within the launch vehicle volume constraints. Further, each satellite must have a custom designed feed horn location and/or a custom shaped reflector to enable the satellite to deliver the desired beam pattern and locations.

It can be seen, then, that there is a need in the art for antenna reflectors that provide multiple distinctly shaped beams. It can also be seen that there is a need in the art for antenna systems that provide distinctly shaped beams for multiple polarizations that are easy to stow within launch vehicle constraints. It can also be seen that there is a need in the art for antenna systems that can deliver a desired beam pattern and location without having to custom design each reflector geometry, e.g., nominal focal axis of the reflector, and feed horn location.

SUMMARY OF THE INVENTION

To overcome the limitations in the prior art described above, and to overcome other limitations that will become apparent upon reading and understanding the present specification, the present invention discloses a method for broadcasting, a signal, and an antenna system. The antenna system comprises a feed horn and a reflector. The feed horn provides a radio frequency (RF) signal. The reflector is aligned with the feed horn and is illuminated by the feed horn, and comprises a reflective grid. The reflective grid lines are substantially parallel as viewed from a geographic location of a desired output beam from the antenna system.

A method in accordance with the present invention comprises illuminating a reflector with RF energy emanating from a feed horn, the feed horn being substantially located at a focal point of the reflector, wherein the reflector comprises a reflective grid, and reflecting the RF energy with the reflective grid, wherein lines of the reflective grid are substantially parallel as viewed from a geographic location of a desired output beam from the antenna system.

The present invention provides an antenna system that provides distinctly shaped beams that are easy to stow within launch vehicle constraints. The present invention also provides an antenna system that provides distinctly shaped beams for multiple polarizations that are easy to stow within launch vehicle constraints. The present invention also provides antenna systems that can deliver a desired beam pattern and location without having to custom design each reflector reflector geometry, e.g., nominal focal axis of the reflector, and feed horn location.

BRIEF DESCRIPTION OF THE DRAWINGS

Referring now to the drawings in which like reference numbers represent corresponding parts throughout.

DETAILED DESCRIPTION OF THE PREFERRED EMBODIMENT

In the following description of the preferred embodiment, reference is made to the accompanying drawings which form a part hereof, and in which is shown by way of illustration a specific embodiment in which the invention may be practiced. It is to be understood that other embodiments may be utilized and structural changes may be made without departing from the scope of the present invention.

Satellite Environment

Figure 1A:
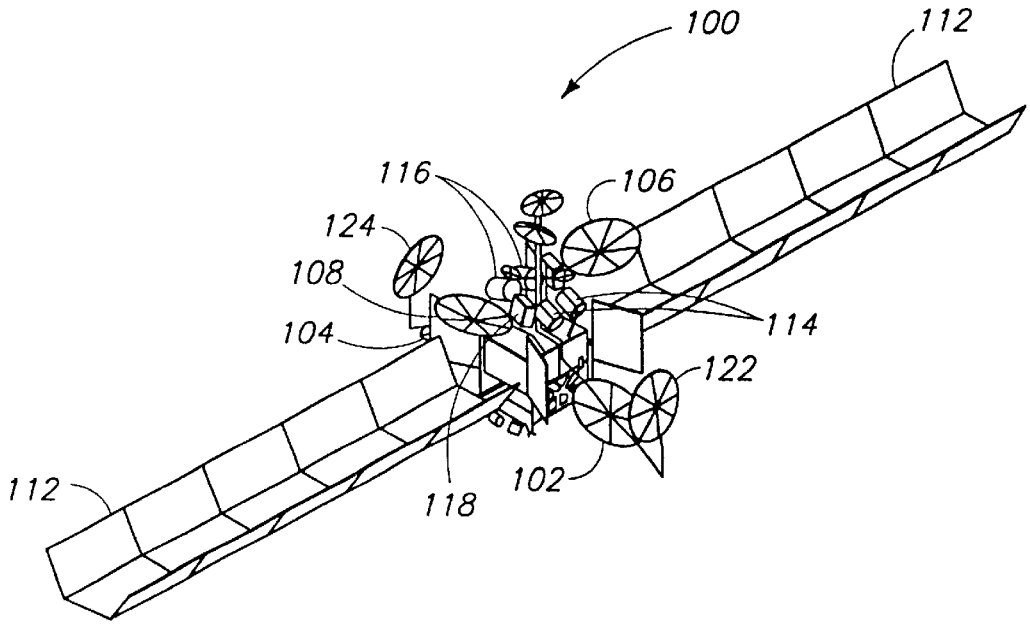
FIGS. 1A and 1B illustrate a typical satellite environment for the present invention.
Figure 1B:
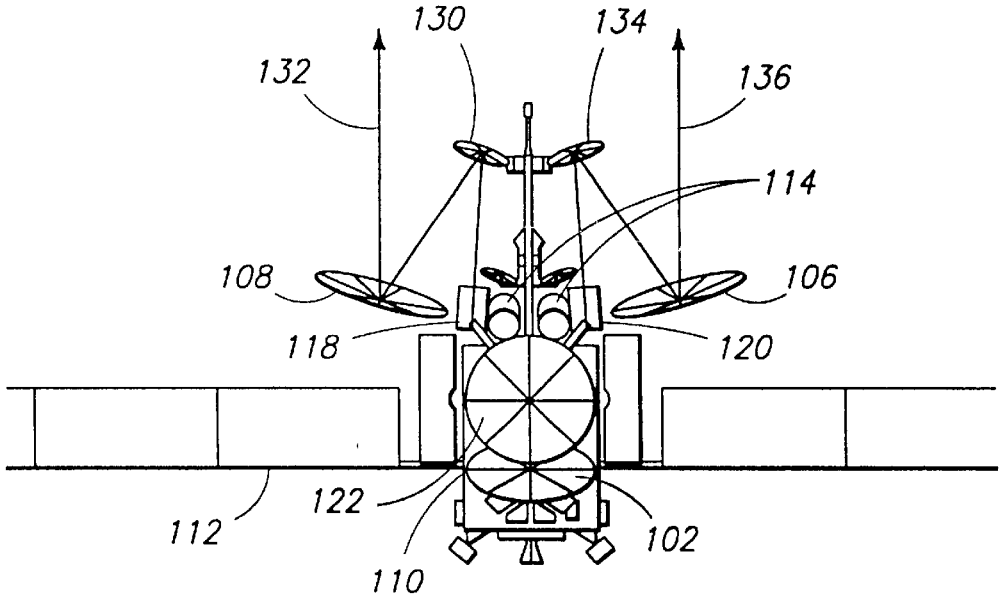

FIGS. 1A and 1B illustrate a typical satellite environment for the present invention.

Spacecraft 100 is illustrated with four antennas 102–108. Although shown as dual reflector antennas 102–108, antennas 102–108 can be direct fed single reflector antennas 102–108 without departing from the scope of the present invention. Antenna 102 is located on the east face of the spacecraft bus 110, antenna 104 is located on the west face of spacecraft bus 110, antenna 106 is located on the north part of the nadir face of the spacecraft bus 110, and antenna 108 is located on the south part of the nadir face of the spacecraft bus 110. Solar panels 112 are also shown for clarity.

Feed horns 114–120 are also shown. Feed horn 114 illuminates antenna 102, feed horn 116 illuminates antenna 104, feed horn 118 illuminates antenna 108, and feed horn 120 illuminates antenna 106. Feed horn 114 is directed towards subreflector 122, which is aligned with antenna 102. Feed horn 116 is directed towards subreflector 124, which is aligned with antenna 104. Feed horns 114–120 can be single or multiple sets of feed horns as desired by the spacecraft designer or as needed to produce the beams desired for geographic coverage. For example, feed horns 114 and 116 are shown as two banks of feed horns, but could be a single bank of feed horns, or multiple banks of feed horns, as desired. Antennas 102 and 104 are shown in a side-fed offset Cassegrain (SFOC) configuration, which are packaged on the East and West sides of the spacecraft bus 110. Antennas 106 and 108 are shown as offset Gregorian geometry antennas, but can be of other geometric design if desired. Further, antennas 102–108 can be of direct fed design, where the subreflectors are eliminated and the feed horns 114–120 directly illuminate reflectors 102–108 if desired. Further, any combination of Cassegrainian, Gregorian, SFOC, or direct illumination designs can be incorporated on spacecraft 100 without departing from the scope of the present invention.

Feed horn 118 illuminates subreflector 130 with RF energy, which is aligned with antenna 108 to produce output beam 132. Feed horn 120 illuminates subreflector 134 with RF energy, which is aligned with antenna 106 to produce beam 136. Beams 132 and 136 are used to produce coverage patterns on the Earth's surface. Beams 132 and 136 can cover the same geographic location, or different geographic locations, as desired. Further, feed horns 118 and 120 can illuminate the antennas 102–108 with more than one polarization of RF energy, i.e., left and right hand circular polarization, or horizontal and vertical polarization, simultaneously.

Although described with respect to satellite installations, the antennas described herein can be used in alternative embodiments, e.g., ground based systems, mobile based systems, etc., without departing from the scope of the present invention. Further, although the spacecraft 100 is described such that the feed horns 114–120 provide a transmitted signal from spacecraft 100 via the reflectors 102–108, the feed horns 114–120 can be diplexed such that signals can be received on the spacecraft 100 via reflectors 102–108.

Overview of the Present Invention

Current day satellites use frequency reuse in order to increase the capacity of satellites. One approach to achieve larger capacity for a satellite is by using the same frequency and orthogonal polarizations for that frequency, e.g., vertical and horizontal polarizations for a linearly polarized system, to achieve additional throughput for the satellite communications system.

Typical satellites use a parabolic shaped reflector 102 at the beginning of the design process, and place the feed horn 114 along the focal axis of the parabolic shaped reflector 102, typically at the focal point of the parabolic reflector 102. The reflector 102 and feed horn 114 are then moved to provide a proper pointing of the beam to be emitted from the parabolic reflector 102. As such, the feed horn 114 can be placed at various places with respect to the spacecraft bus. The reflector 102 surface is then shaped to provide a beam pattern of desired shape, and gridded surfaces are then added along the shaped reflector. The gridded surfaces are applied to the shaped surface such that, in the related art, the grid lines are parallel as seen from the focal axis of the reflector 102, e.g., from the position of the feed horn 114.

When a satellite uses a common reflector system with multiple grids for orthogonally polarized signals, each signal is impingent upon both reflective grids of the reflector, which results in reflections of both polarizations from each reflective surface. Since each reflective surface is designed to reflect only one of the two orthogonal signals, the unwanted reflection, e.g., from the other or "cross-polarization" signal for that gridded surface, must be small for the overall system to operate efficiently. This small cross-polarization reflection characteristic is difficult to achieve.

The antenna configuration which is primarily used in many satellites is the dual gridded reflector. With a dual gridded reflector approach, good polarization purities, i.e., low cross-polarization characteristics for each gridded reflector, are obtained by gridding the surfaces of the dual gridded reflector with conducting grids. The two reflecting surfaces are gadded in two orthogonal directions, although in some designs, only the front surface is gridded with a reflective grid. The direction of the grid(s) control the polarization characteristics of the antenna in both the desired polarization ("co-polarization characteristics") and the undesired polarization ("cross-polarization characteristics").

Each surface (grid) of the dual-gridded reflector with the associated feed horn or feed horn array can be designed to produce a shaped beam of any size and location. Since there are two reflective surfaces on each reflector, two shaped beams can be produced from a single dual gridded reflector, each operating in one of the two orthogonal polarizations. Each surface can be either a shaped reflector fed by a single feed or a parabolic reflector fed by a feed array. The beams can be designed to be in any arbitrary direction with reference to the focal axis, i.e., the direction of focal axis can be either within the coverage area or outside the coverage area.

Off-axis beams can be generated from a paraboloid shaped reflector by using a feed horn array located away from the focus of the paraboloid shaped reflector. In a shaped reflector the off-axis beams can be generated by suitably shaping the reflector. This approach has significant mechanical advantage since the feed reflector geometry remains essentially the same for many different shaped beams.

The cross-polar performance of the reflector is controlled by the shape of the grids, because the grids generally support the currents in only one direction. The present invention involves shaping the grids in such a way to improve the cross-polar performance of the reflector by orienting the grids with respect to the desired beam pattern, as opposed to orienting the grids with respect to the feed location, e.g., locating the feed horn along the nominal focal axis of the reflector, as in the related art. This more optimal grid direction depends on the direction of the shaped beams with reference to the antenna geometry, as opposed to having a grid direction that is seen as parallel as seen from the nominal axis of the reflector.

Reflector Design

Figure 2:
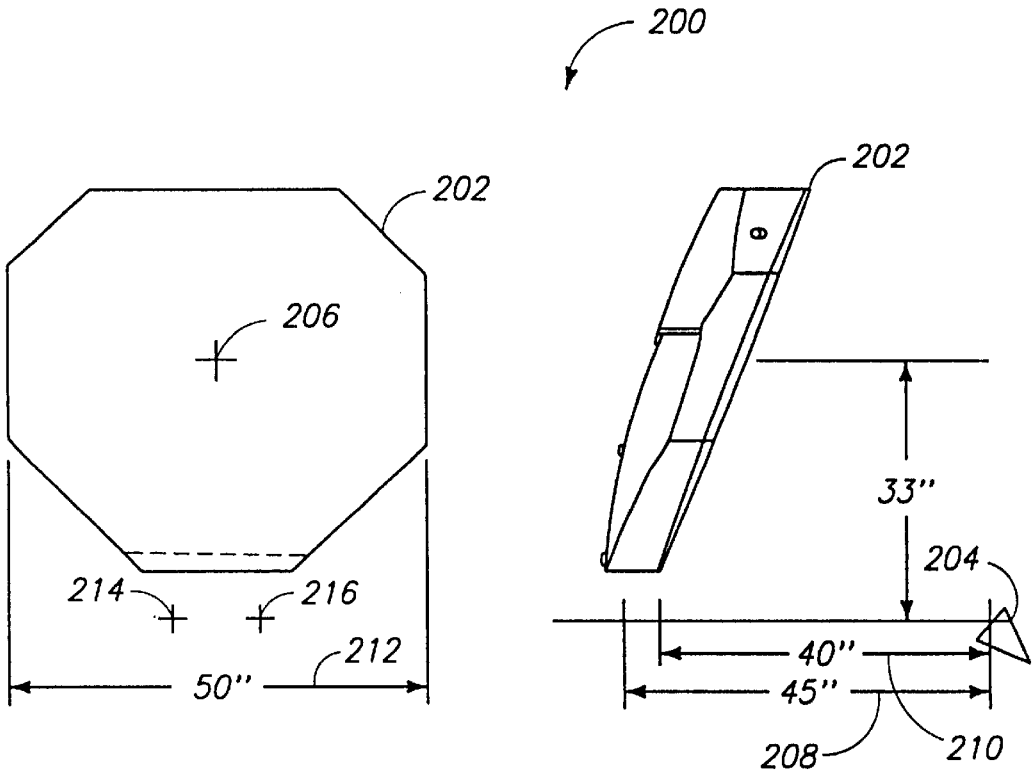
FIG. 2 illustrates front and side views of a typical reflector system for satellite communications.

FIG. 2 illustrates front and side views of a typical reflector system for satellite communications.

System 200 shows a reflector 202 and a feed horn 204 directed at the reflector 202. The focal point 206 of the reflector 202 is primarily responsible for the direction of the beam that emanates from the reflector 202. Reflector 202 is similar to reflectors 102–108 described in FIGS. 1A and 1B.

Reflector 202 typically has a five inch depth at the bottom of reflector 202 as shown by the dimensions 208 and 210. Typical width dimension 212 and feed horn 202 locations 214 and 216 are shown.

Figure 3A:
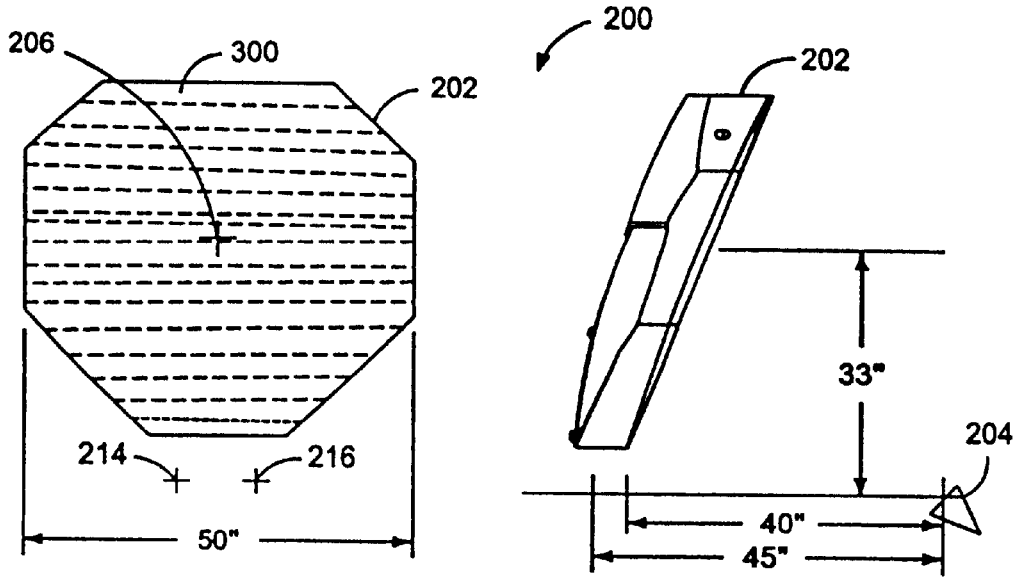
FIG. 3A illustrates the grids of a related art reflector.

FIG. 3A illustrates the grids of a related art reflector.

Grid 300 is shown as one of the reflective surfaces for reflector 202. Another grid which is substantially orthogonal to grid 300 is also present on reflectors 202 that have dual gridded surfaces. In present day dual gridded reflectors 202, the grids 300 are designed such that the grids 300 on a single surface look parallel as seen along the focal axis of the paraboloid, e.g., as viewed along a normal axis emanating from focal point 206. Such grids provide inferior cross-polar performance when the reflector is being illuminated by a feed horn 204 that is located away from the focal axis, also known as an off-axis beam or off-axis geometry. As such, the grid 300 has an increased cross-polarization characteristic, which degrades the quality of the signal for each of the polarizations and requires additional design time to properly design the antenna system 100. Additional time must be spent optimizing the grid 300 design, and additional time must be spent determining the proper feed horn 204 location, since locations 214 and 216 typically cannot provide the proper cross-polarization performance characteristics for a given feed horn 204. As such, each satellite design, and therefore each system 200 design, is unique, and typically cannot be used on another satellite mission.

The present invention, which shapes the grid 300 lines in a different direction based on the desired geographic beam location, results in improved cross-polar performance for off-axis beams in comparison to the approach shown in FIG. 3A. In applications in which the front and back grids 300 on reflector 202 generate beams that will be impingent on different geographic locations, e.g., the front grid 300 beam will be impingent upon geographic locations in the southwestern United States, whereas the beam impingent upon the rear grid 300 will be impingent upon geographic locations in the northeastern United States, the present invention allows the designer to choose a more optimum grid direction for each grid, and therefore for each beam, which results in better cross-polar performance for both beams.

Figure 3B:
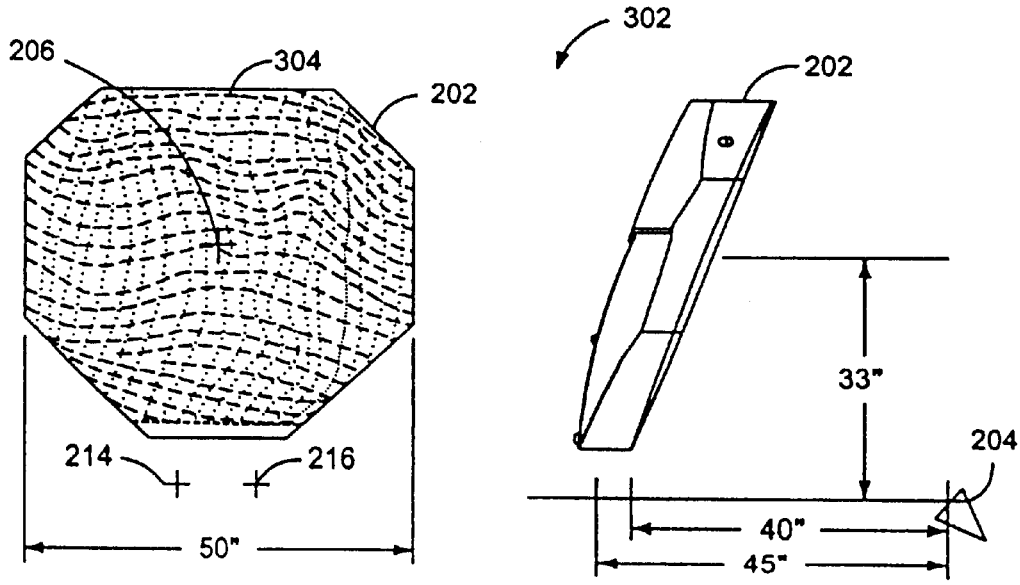
FIG. 3B illustrates a typical grid design of the present invention.

FIG. 3B illustrates a typical grid design of the present invention. System 302 now employs a non-parallel grid 304 as seen from the focal axis of the reflector 202, for one or more of the reflective surfaces for reflector 202. Grid 304 can now allow designers to leave feed horn 204 at either position 214 or 216 for a variety of mission objectives, and leave reflector 202 as a standard shape and size, while still providing a desired beam shape and size. The non-parallel grid 304 of the present invention allows the grid to have a "parallel" viewpoint as seen from the geographic location of the desired beam that emanates from system 302, not a "parallel" viewpoint as viewed from an axis emanating from focal point 206. Although shown as curved lines, non-parallel grid 304 can also be a grid of substantially parallel straight lines that is rotated through any angle with respect to the focal point 206, can have different spacings between the grid 304 lines, comprise a free form array of grid lines, or any combination of spacing differences and/or nonlinearities to achieve the desired geographic beam cross-polarization coverage.

The present invention helps standardize the system 302 to allow a single system 302 to serve multiple mission scenarios. The present invention allows designers to focus on a single design problem, e.g., the shape and geometry of the grid 304, instead of multiple design problems, e.g., the grid 304 geometry, the feed horn 204 location, the reflector 202 size, shape, and depth, etc.

The present invention also allows each shaped reflector 202 to be boresighted in the same direction, e.g., the sub-satellite direction, as opposed to the related art, where each antenna has an individual boresight. The sub-satellite direction is the direction pointing from the center of the Earth to the focal point of the antenna reflector. This single boresight design feature allows for mechanical simplicity in spacecraft manufacturing, since the feed horn 204 for each satellite can now be located at the same position for many beam designs, resulting in very similar mechanical designs over many satellites.

Resultant Beam Coverage

Figure 4:
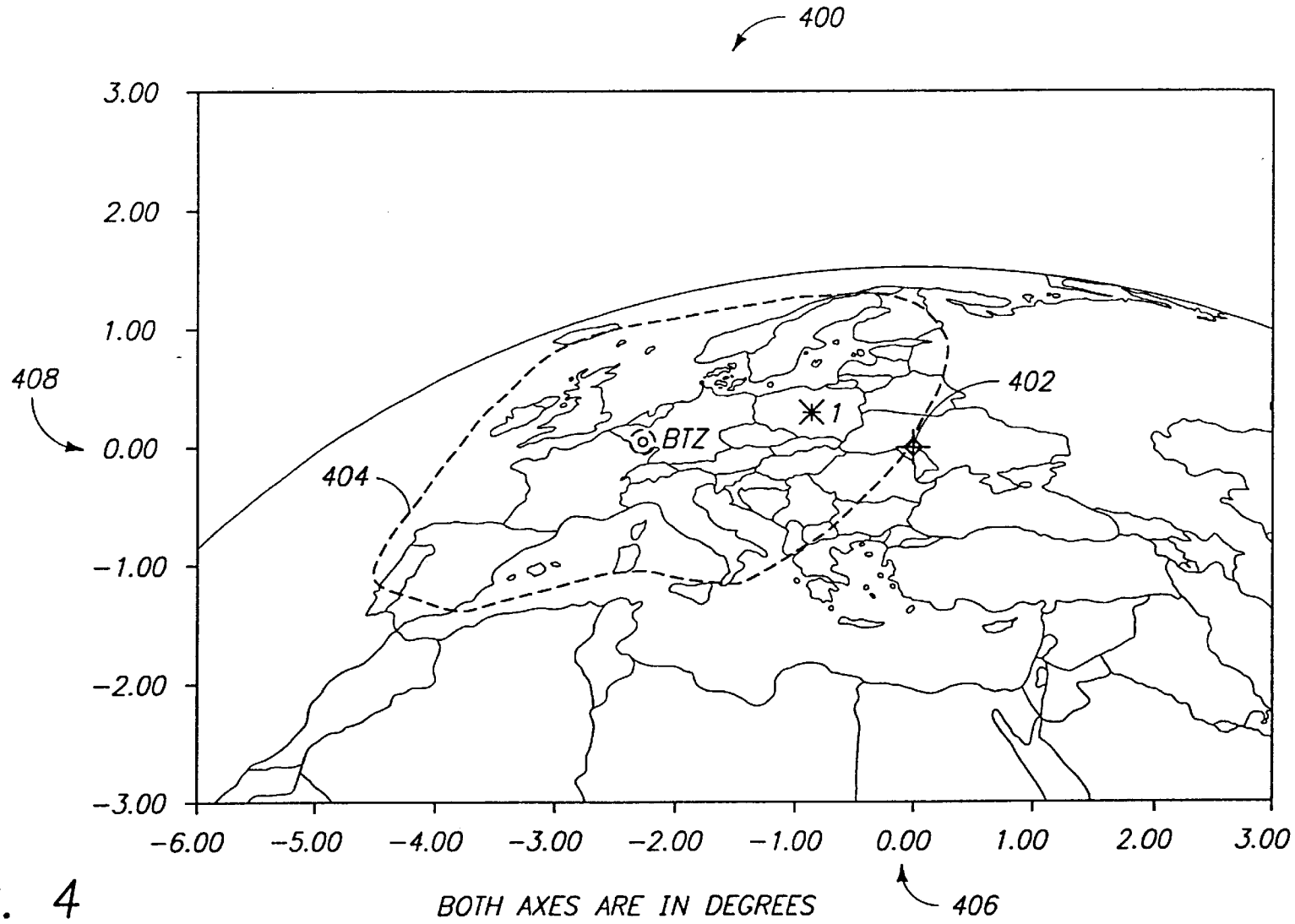
FIG. 4 illustrates a beam design with the boresight within the designed geographic coverage area.

FIG. 4 illustrates a beam design with the boresight within the designed geographic coverage area.

Beam design 400 illustrates boresight 402, i.e., an axis that emanates substantially normal from the focal point 106 of reflector 202, marginally within geographic coverage area 404. Geographic coverage area 404 is shown as covering Western Europe, e.g., Spain, France, the United Kingdom, etc., but geographic coverage area 404 can cover any desired geographic location. Boresight 402 is located at zero degrees point 406 and zero degrees point 408 on beam design 400.

Figure 5:
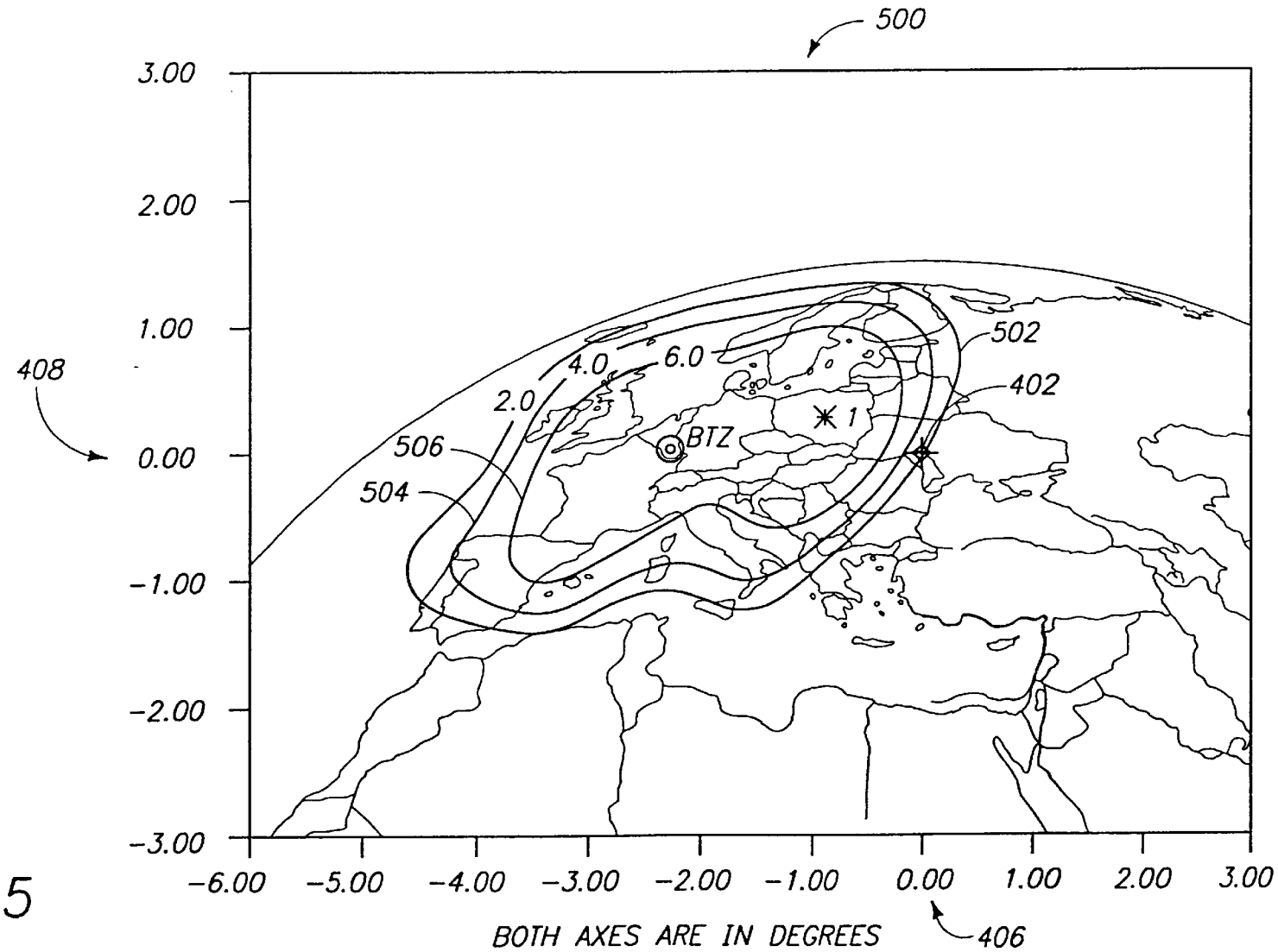
FIG. 5 illustrates the co-polar performance of an antenna system described with respect to FIG. 4.

FIG. 5 illustrates the co-polar performance of an antenna system described with respect to FIG. 4.

Beam pattern 500 shows lines 502–506 of constant power for the design described in FIG. 4, i.e., where the boresight 402 is located within the desired coverage pattern.

Figure 6:
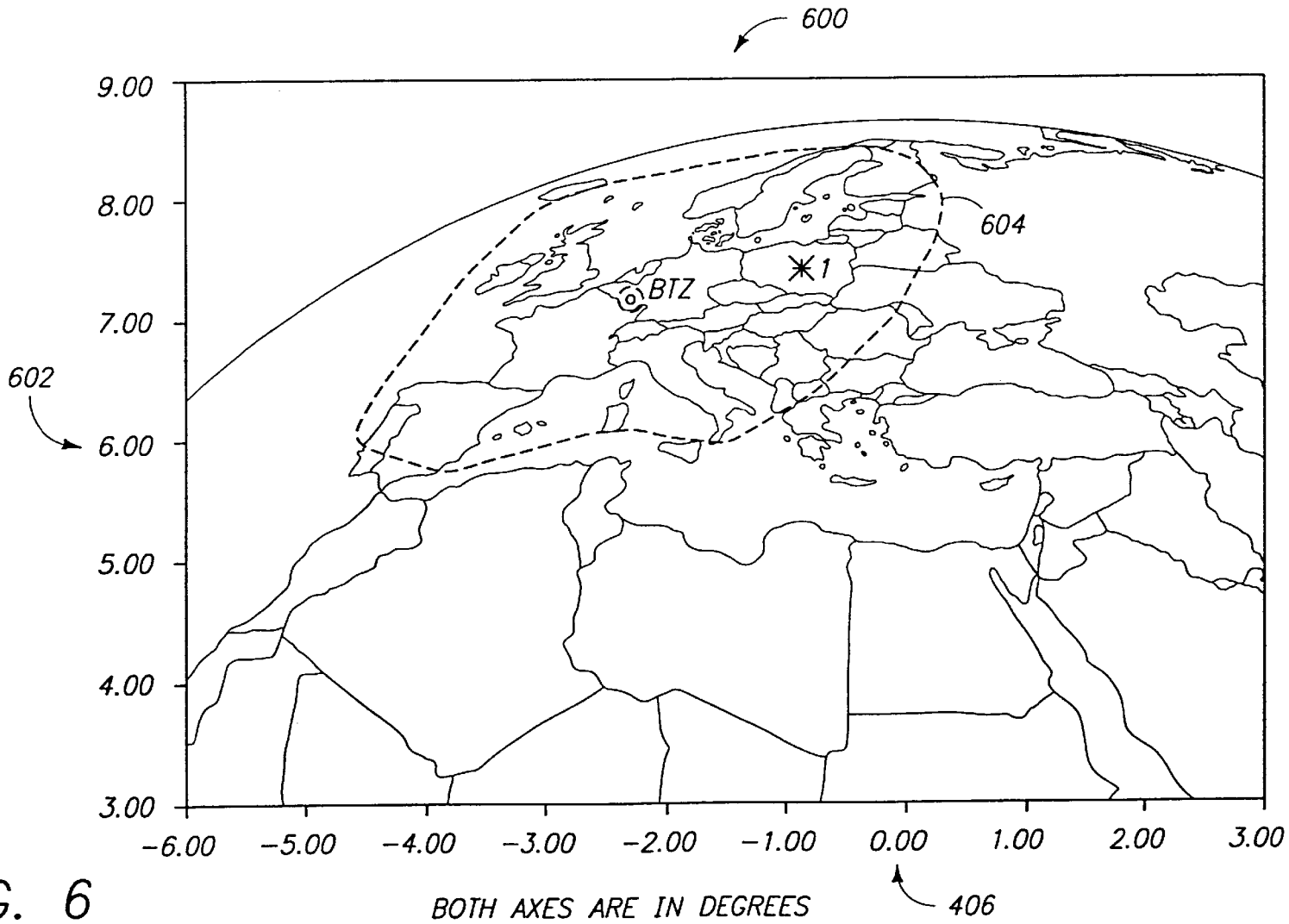
FIG. 6 illustrates a beam design with the boresight outside of the designed geographic coverage area.

FIG. 6 illustrates a beam design with the boresight outside the designed geographic coverage area.

Beam design 600 no longer illustrates the boresight, i.e., an axis that emanates substantially normal from the focal point 106 of reflector 202, because although zero degree point 406 is still indicated, the zero degree point for the elevation is not indicated. The center of the beam design is at a six degree point 602, and thus, the boresight is no longer marginally within geographic coverage area 604. Geographic coverage area 604 is shown as covering Western Europe, e.g., Spain, France, the United Kingdom, etc., but geographic coverage area 604 can cover any desired geographic location.

Figure 7:
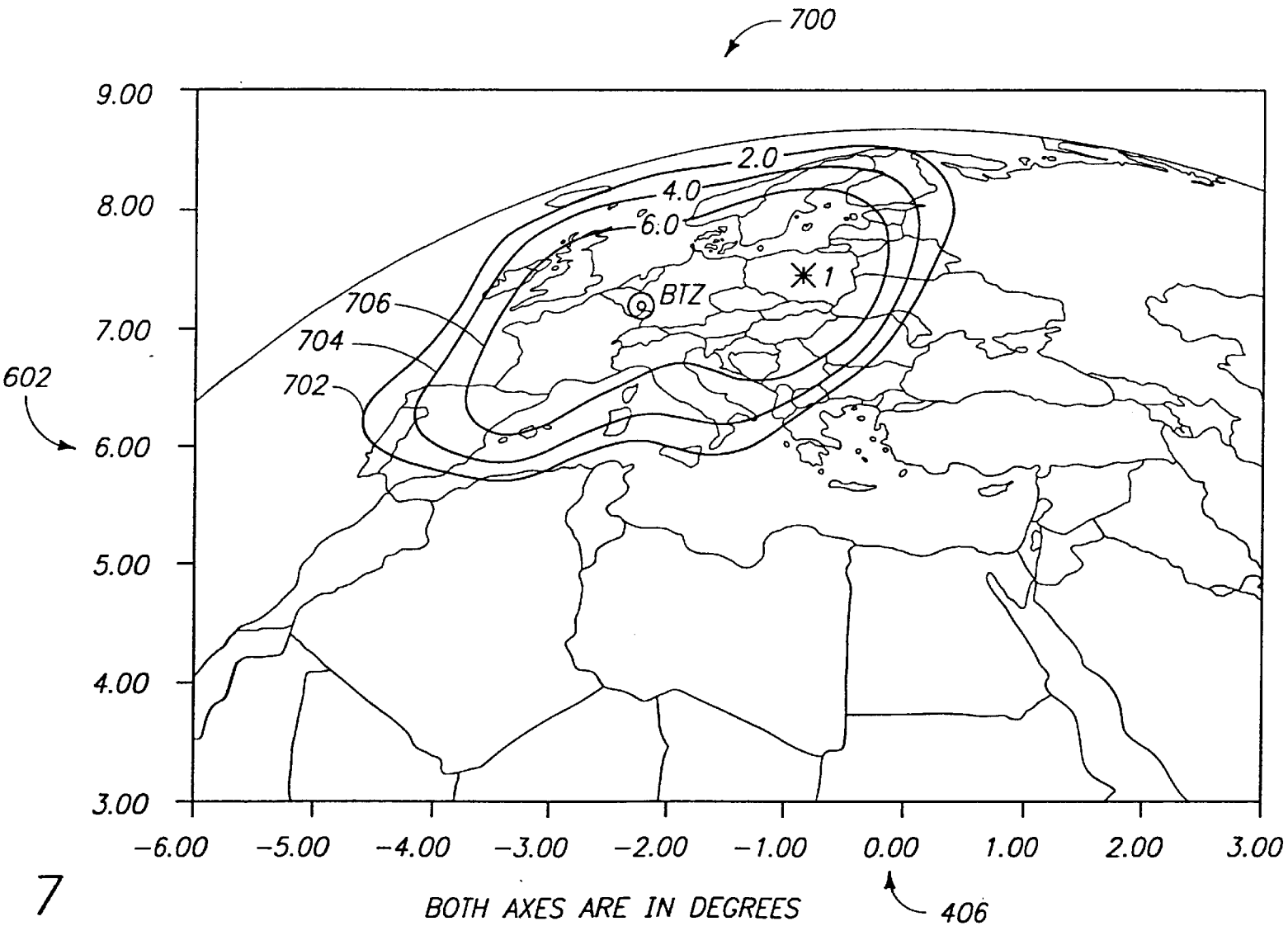
FIG. 7 illustrates the co-polar performance of an antenna system described with respect to FIG. 6.

FIG. 7 illustrates the co-polar performance of an antenna system described with respect to FIG. 6.

Beam pattern 700 shows lines 702–706 of constant power for the design described in FIG. 6, i.e., where the boresight 402 is not located within the desired coverage pattern. The beam pattern 700 closely emulates the beam pattern 500 illustrated in FIG. 5.

For beam patterns 500 and 700, the reflective grids for reflectors 202 were designed to be parallel as seen along the reflector 202 boresight 402. Even though the boresight 402 moved, e.g., was substantially within the coverage area in FIGS. 4 and 5, and was not within the coverage area in FIGS. 6 and 7, the co-polarization characteristics of the beam patterns 500 and 700 were almost identical.

However, the cross polarization characteristics of the two beam patterns 500 and 700 are quite different.

Illustration of Co-polarization and Cross-polarization Patterns

Figure 8:
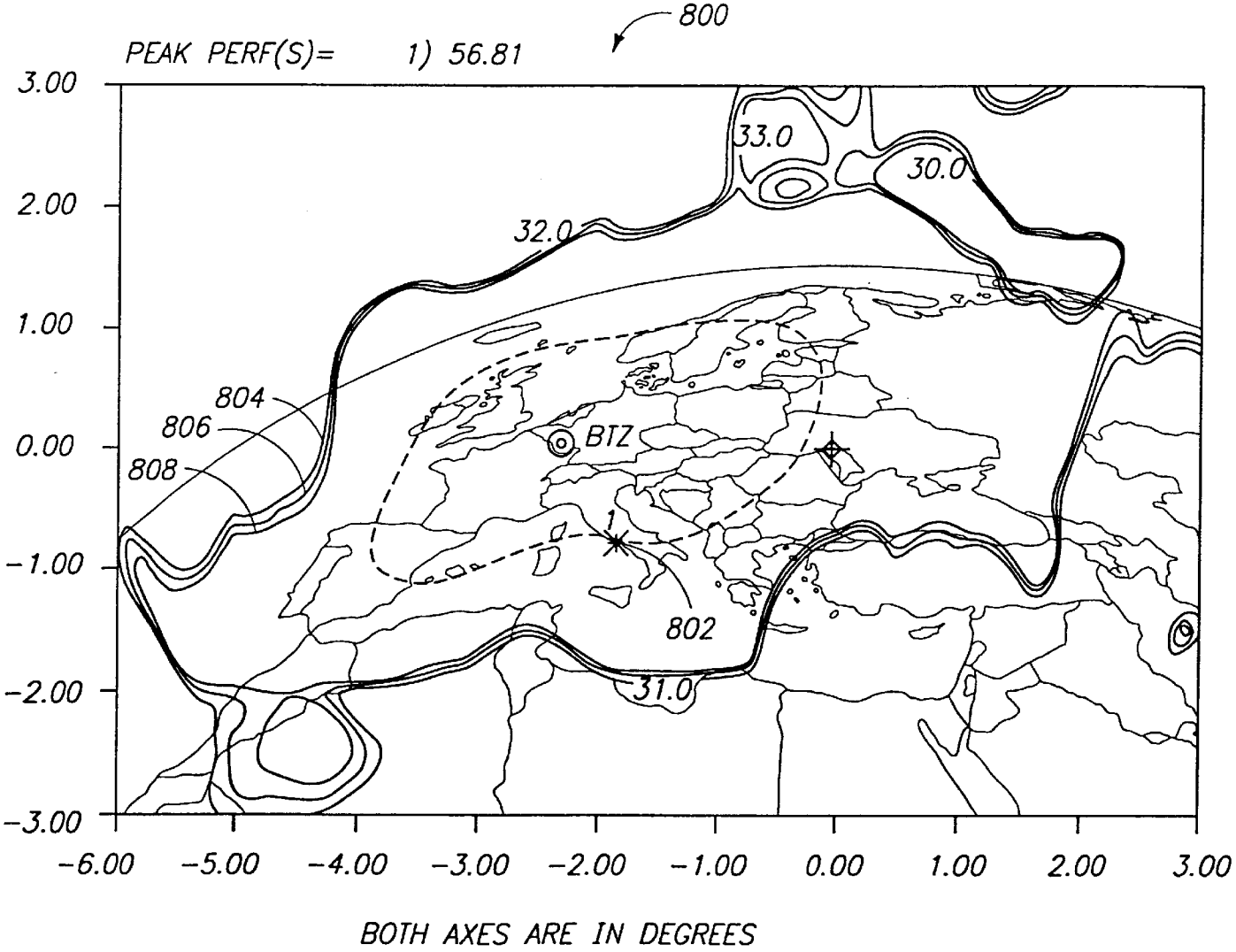
FIG. 8 illustrates the cross-polarization characteristics of a system with the boresight substantially within the coverage area.

FIG. 8 illustrates the cross-polarization characteristics of a system with the boresight substantially within the coverage area.

Beam pattern 800 illustrates the cross-polarization patterns measured as a ratio between the co-polar and cross-polar measurements (also known as the C/I ratio) for system 500, with a peak C/I performance at point 802 of 56.81 dB, at approximately minus 2 degrees azimuth, minus one degree elevation. Lines 804–808 illustrate lines of constant power, with line 804 corresponding to 33 dB, line 806 corresponding to 32 dB, and line 808 corresponding to 31 dB.

Figure 9:
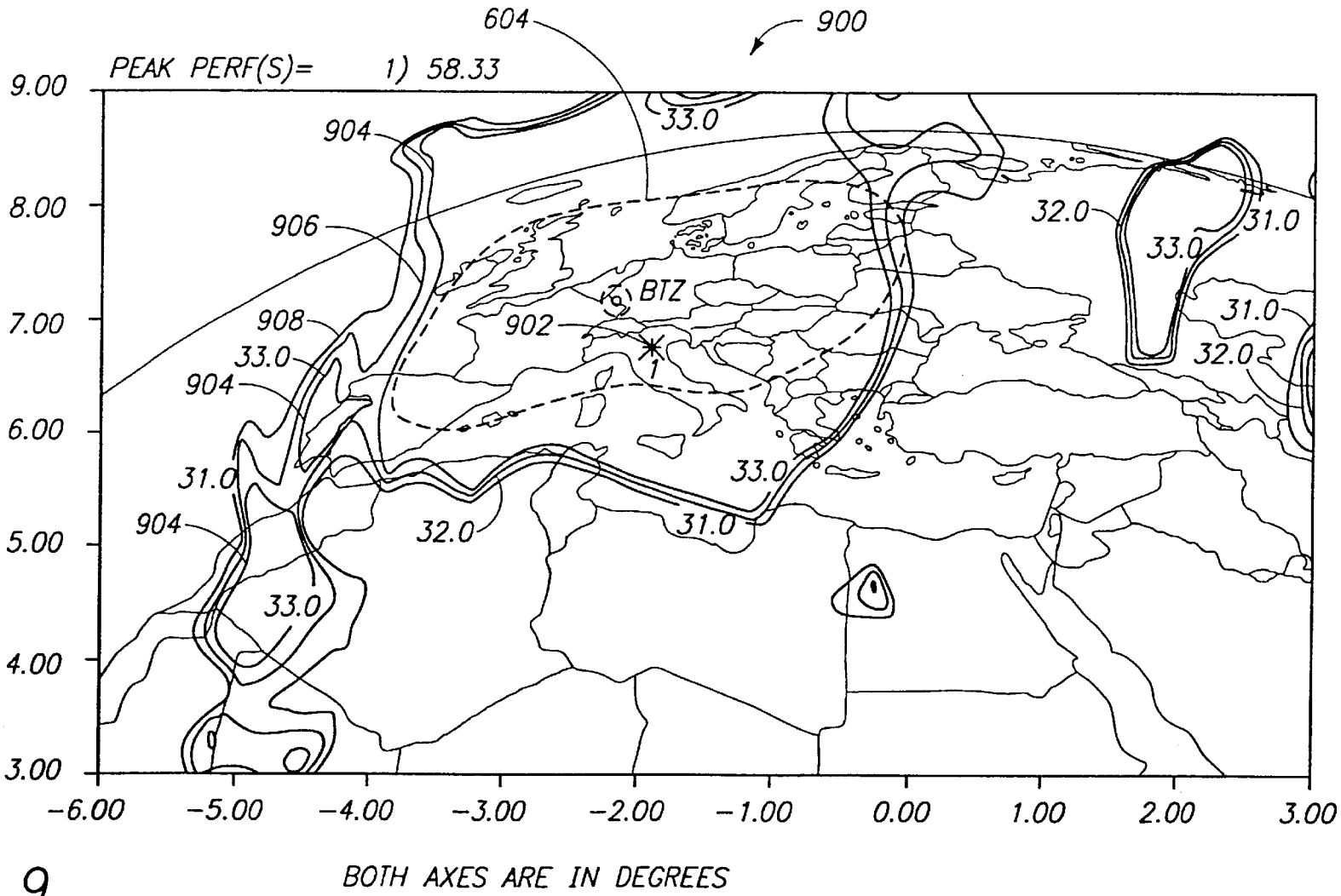
FIG. 9 illustrates the cross-polarization characteristics of a system with the boresight outside of the coverage area.

FIG. 9 illustrates the cross-polarization characteristics of a system with the boresight outside of the coverage area.

Beam pattern 900 illustrates the cross-polarization patterns measured as a ratio between the co-polar and cross-polar measurements of system 700, with a peak performance at point 902 of 58.33 dB, at approximately minus 2 degrees azimuth, plus seven degrees elevation. Lines 904–908 illustrate lines of constant power, with line 904 corresponding to 33 dB, line 906 corresponding to 32 dB, and line 908 corresponding to 31 dB. When compared to the beam pattern 800 of FIG. 8, the patterns are rather different, and the peak C/I performance of beam pattern 900 is approximately 3 dB worse than the system 500 that has the boresight located in the coverage region as shown in FIG. 8. Note that in beam pattern 900, lines 904, 906, and 908 now cross over desired coverage area 604, which means that the C/I ratio is lower for beam pattern 900 than the C/I ratio for beam pattern 800, which does not have any similar power level lines crossing over the desired coverage area 604.

Figure 10:
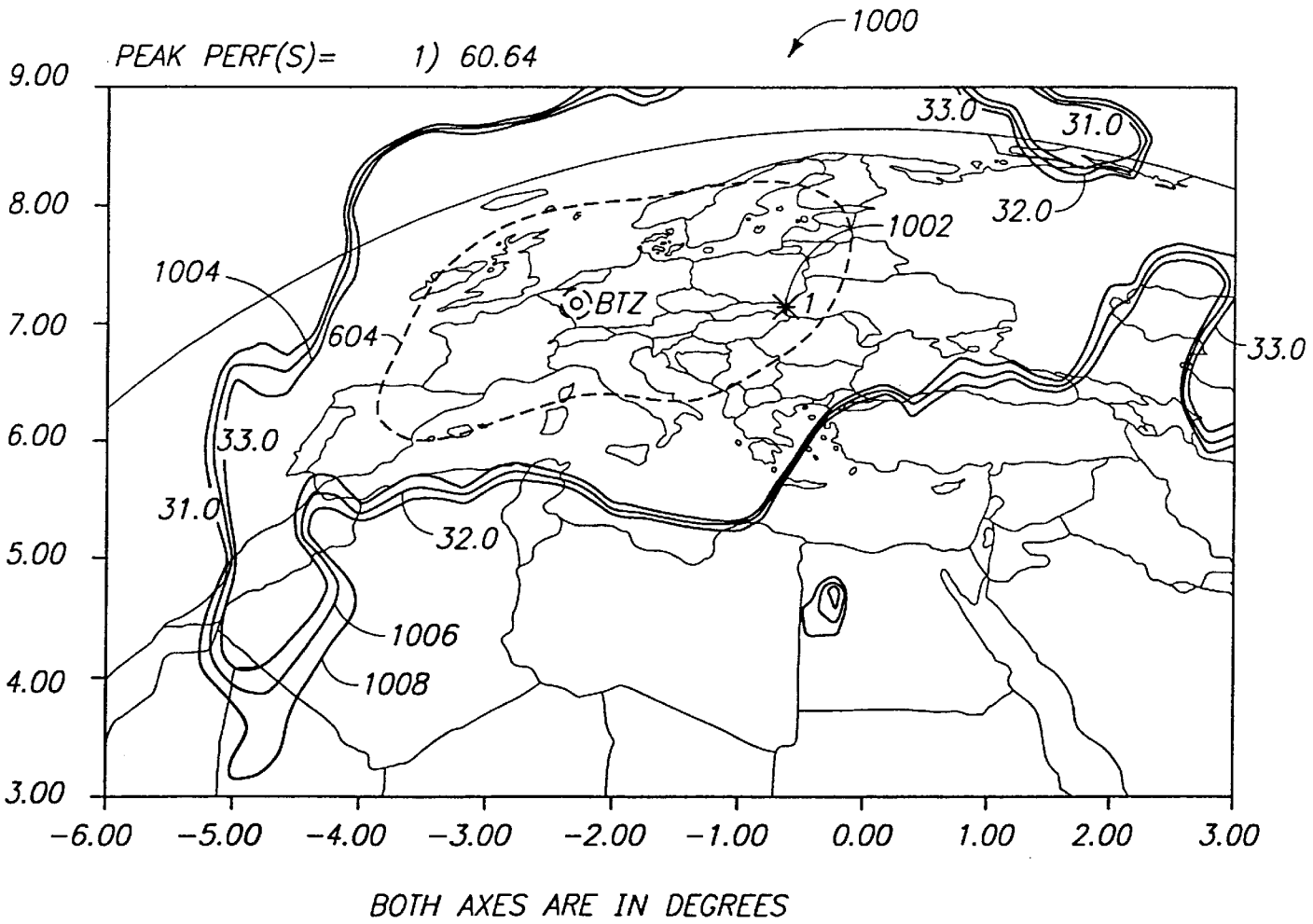
FIG. 10 illustrates the cross-polarization characteristics of a system utilizing the grid patterns of the present invention, with the boresight outside of the coverage area.

FIG. 10 illustrates the cross-polarization characteristics of a system utilizing the grid patterns of the present invention, with the boresight outside of the coverage area.

Beam pattern 1000 illustrates the cross-polarization patterns measured as a ratio between the co-polar and cross-polar measurements of the system of the present invention, with a peak performance at point 1002 of 60.64 dB, at approximately minus 1 degrees azimuth, plus seven degrees elevation. Lines 1004–1008 illustrate lines of constant power, with line 1004 corresponding to 33 dB, line 1006 corresponding to 32 dB, and line 1008 corresponding to 31 dB. Note again that the C/I ratio for beam pattern 1000 is similar to that of beam pattern 800 of FIG. 8, which is a large improvement over the beam pattern 900 shown in FIG. 9. The cross-polarization characteristics of the present invention, as shown in FIG. 10, allow spacecraft designers to have a fixed feed horn location on the spacecraft, and maneuver the beam location solely through the shaping and pointing of the reflector, by using the non-parallel grid lines to lower the cross-polarization characteristics of the antenna system. As such, manufacturing of spacecraft systems will require less design time and less manufacturing time, since the feed horn can now be located at a common position for various mission scenarios.

When compared to the C/I beam patterns of FIGS. 8 and 9, the beam pattern 1000 of FIG. 10 illustrates that the cross-polarization characteristics of the present invention are much better compared to those of the related art. The peak performance of a system made in accordance with the present invention has better peak performance than the related art, and has a C/I ratio comparable to if not greater than the boresight-dependent antennas of the related art. The grid design that produced beam pattern 1000 is a grid that is designed to be parallel as seen at an angle inclined at about 7 degrees from the sub-satellite boresight. The co-polarization performance is similar to that shown in FIGS. 5 and 7, and was unaffected by the grid design.

Process Chart

Figure 11:
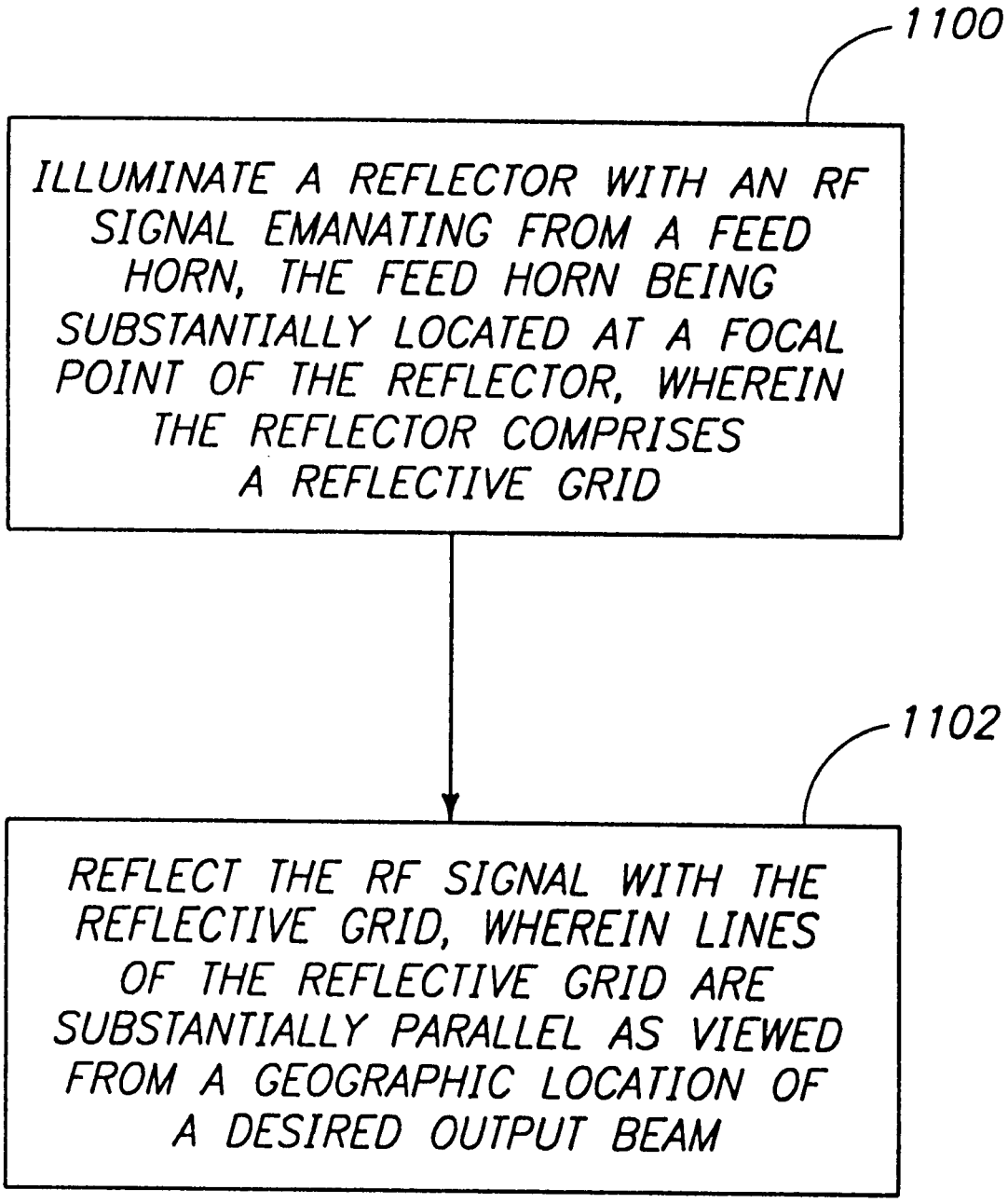
FIG. 11 is a flow chart illustrating the steps used to practice the present invention.

FIG. 11 is a flowchart illustrating the steps used to practice the present invention. Block 1100 illustrates performing the step of illuminating a reflector with an RF signal emanating from a feed horn, the feed horn being substantially located at a focal point of the reflector, wherein the reflector comprises a reflective grid.

Block 1102 illustrates performing the step of reflecting the RF signal with the reflective grid, wherein lines of the reflective grid are substantially parallel as viewed from a geographic location of a desired output beam.

Conclusion

This concludes the description of the preferred embodiment of the invention. The following paragraphs describe some alternative methods of accomplishing the same objects. The present invention, although described with respect to RF systems, can also be used with optical systems or lensed RF systems to accomplish the same goals. Further, multiple antenna systems 302 as described can reside on a single satellite, providing further flexibility in satellite design. The antenna system of the present invention can also be used in other applications, such as ground based antenna systems, or tracking radar systems.

The antenna of the present invention can also use dual grids within the reflector 202 to reflect multiple polarizations of RF signals at substantially the same frequency, or RF signals of different frequencies. As an example, the outer grid 302 of the reflector 202 reflects substantially horizontally polarized signals, and a second grid 302 of the reflector 202 reflects substantially vertically polarized signals. Either surface on reflector 202 can be designed to reflect any polarization of signal.

In summary, the present invention discloses a method for broadcasting, a signal, and an antenna system. The antenna system comprises a feed horn and a reflector. The feed horn provides a radio frequency (RF) signal. The reflector is aligned with the feed horn and is illuminated by the feed horn, and comprises a reflective grid. The reflective grid lines are substantially parallel as viewed from a geographic location of a desired output beam from the antenna system.

A method in accordance with the present invention comprises illuminating a reflector with an RF signal emanating from a feed horn, the feed horn being substantially located at a focal point of the reflector, wherein the reflector comprises a reflective grid, and reflecting the RF signal with the reflective grid, wherein lines of the reflective grid are substantially parallel as viewed from a geographic location of a desired output beam from the antenna system.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. An antenna system, comprising:

a feed horn, wherein the feed horn provides a radio frequency (RF) signal; and a reflector, aligned with the feed horn, the reflector being illuminated by the feed horn, comprising a reflective grid, wherein lines of the reflective grid are substantially parallel as viewed from a geographic location of a desired output beam from the antenna system;

wherein the geographic location is off a focal axis of the reflector.

2. The antenna system of claim 1,wherein the reflector is substantially paraboloid in shape.

3. The antenna system of claim 1, further comprising:

a second feed horn, wherein the second feed horn provides a second radio frequency (RF) signal, and the reflector further comprises a second reflective grid, orthogonally polarized with respect to the reflective grid, wherein the feed horn illuminates the reflector with a fist polarization and the second feed horn illuminates the reflector with a second polarization substantially orthogonal to the first polarization.

4. The antenna system of claim 3, wherein the reflective grid and the second reflective grid are illuminated by the feed horn and the second feed horn at the same time.

5. The antenna system of claim 4, wherein the feed horn illuminates the reflector with horizontally polarized signals and the second feed horn illuminates the reflector with vertically polarized signals.

6. The antenna system of claim 3, wherein the RF signal and the second RF signal are at substantially the same frequency.

7. The antenna system of claim 1, wherein the reflective grid comprises a grid of substantially parallel lines that has been rotated with respect to a focal point of the reflector.

8. The antenna system of claim 1, wherein the reflective grid comprises a free form reflective grid having different spacings between lines.

9. A method of broadcasting a signal, comprising:

illuminating a reflector with an RF signal emanating from a feed horn, the feed horn being substantially located at a focal point of the reflector, wherein the reflector comprises a reflective grid; and reflecting the RF signal with the reflective grid, wherein lines of the reflective grid are substantially parallel as viewed from a geographic location of a desired output beam;

wherein the geographic location is off a focal axis of the reflector.

10. The method of claim 9, wherein the reflector is substantially paraboloid in shape.

11. The method of claim 9, further comprising:

illuminating the reflector with a second feed horn simultaneous with illuminating the reflector with the first feed horn, wherein the second feed horn provides a second radio frequency (RF) signal, the reflector further comprising a second reflective grid; and reflecting the second RF signal from the second reflective grid, wherein the second reflective grid is orthogonally polarized with respect to the reflective grid.

12. The method of claim 11, wherein the feed horn illuminates the reflector with horizontally polarized signals and the second feed horn illuminates the reflector with vertically polarized signals.

13. The method of claim 11, wherein the RF signal and the second RF signal are at substantially the same frequency.

14. The method of claim 9, wherein the reflective grid comprises a grid of substantially parallel lines that has been rotated with respect to a focal point of the reflector.

15. A signal broadcast from a satellite, formed by:

illuminating a reflector with an RF signal emanating from a feed horn, the feed horn being substantially located at a focal point of the reflector, wherein the reflector comprises a reflective grid; and reflecting the RF signal with the reflective grid, wherein lines of the reflective grid are substantially parallel as viewed from a geographic location of a desired output beam wherein the geographic location is off a focal axis of the reflector.

* * * * *